US005836111A

United States Patent [19]

Tak

[11] Patent Number: 5,836,111

[45] Date of Patent: Nov. 17, 1998

[54] OPENING-CLOSING DEVICE FOR WINDOWS

[75] Inventor: Dong H. Tak, Seoul, Rep. of Korea

[73] Assignee: Fine Industries, Inc., Chungcheongbuk-do, Rep. of Korea

[21] Appl. No.: 633,026

[22] Filed: Apr. 16, 1996

[51] Int. Cl.[6] ..... E05D 13/00

[52] U.S. Cl. ..... 49/425; 49/176; 49/246; 49/394

[58] Field of Search ..... 49/149, 163, 164, 49/176, 168, 394, 425, 246

[56] References Cited

U.S. PATENT DOCUMENTS

| | | | |
|---|---|---|---|
| 3,106,254 | 10/1963 | Grossman | 49/425 X |
| 3,775,905 | 12/1973 | Frank | 49/149 X |
| 4,044,504 | 8/1977 | Nakada | 49/425 |
| 5,371,971 | 12/1994 | Prete . | |

FOREIGN PATENT DOCUMENTS

| | | | |
|---|---|---|---|
| 2156175 | 5/1973 | Germany | 49/425 |
| 2511337 | 9/1976 | Germany | 49/425 |
| 237788 | 8/1992 | Japan . | |
| 327675 | 11/1992 | Japan . | |
| 4343989 | 11/1992 | Japan | 49/425 |
| 89504 | 3/1989 | Rep. of Korea . | |
| 911118 | 2/1991 | Rep. of Korea . | |
| 4027015 | 11/1994 | WIPO | 49/425 |

*Primary Examiner*—Jerry Redman
*Attorney, Agent, or Firm*—James Creighton Wray; Meera P. Narasimhan

[57] ABSTRACT

An opening/closing device for windows is disclosed, in which the windows can be opened in a tilt manner and a sliding manner selectively. The conventional windows can be opened either in a tilt manner or in a sliding manner, but they do not have the composite functions but only a single one. The present invention includes two composite functions, i.e., the tilt opening and slide opening. One ends of links 8 having guide rollers 9 are pivotally secured to an upper frame of the windows 2 and 3 which are accommodated within an outer frame 1. The guide roller 9 can move along a guide rail 11 which is formed on a top segment 1*a* of the outer frame 1. A sliding roller 12 with an auxiliary roller attached thereon is installed in a lower frame df of each of the windows 2 and 3, and the sliding roller 12 can move along a sliding rail 13 which is formed on a bottom segment 1*b* of the outer frame 1. A pair of locks 7 are provided on both ends of the upper frame uf of each of the windows 2 and 3 so as to lock or release the links 8. The locks 7 can be operated by means of a button 5 which is installed adjacently to a window knob 4. Thus the windows can be opened and closed in a tilt manner by manipulating the button 5, while, if the button is not touched, the links 8 are fixed to the windows, and therefore, the windows can be opened/closed in sliding manner.

12 Claims, 5 Drawing Sheets

FIG. 8A
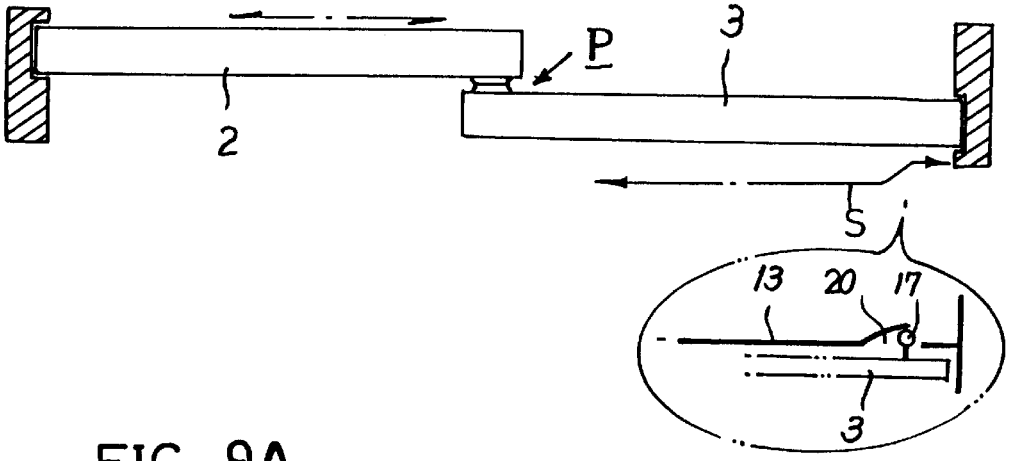
FIG. 8B
FIG. 9A
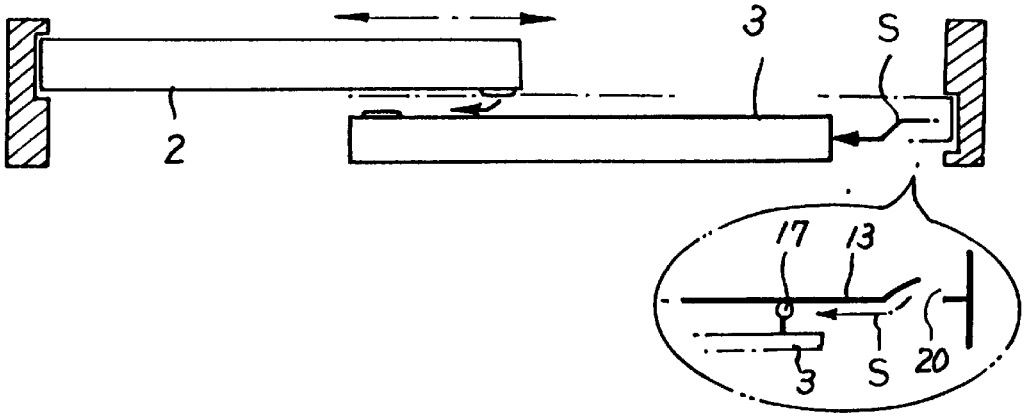
FIG. 9B

OPENING-CLOSING DEVICE FOR WINDOWS

FIELD OF THE INVENTION

The present invention relates to an opening/closing device for windows, in which the windows can be opened in a tilt manner and a sliding manner selectively.

BACKGROUND OF THE INVENTION

In an office building or an apartment building, windows are installed such that their opening/closing methods are diversified.

That is, there are door type pivotal windows, tilt windows, and sliding windows.

In the door type pivotal windows, a side frame of the window is secured to an outer frame by means of hinges, and the window is opened and closed pivotally around the hinges. These pivotal windows are widely used in the general residential houses, because they have a wide opening angle, and the air ventilation is good. However, they are poor in the sealing and safety characteristics against rain and wind, and therefore, they are not much employed in office buildings and apartment buildings.

In the tilt window, the middle or arbitrary points of the left and right frames of the window are rotatably secured to the left and right sides of the outer frames. Thus the window is opened like scissors, in such a manner that the upper or lower portion of the window is opened projectingly in an inclined form. This window has good sealing and safety characteristics, and therefore, this window is used widely in the tall office buildings. However, its opening angle range is narrow, and therefore, the ventilation characteristics are not good.

In the sliding window, sliding rollers are attached on the bottom of the window, so that the window can slide horizontally along a guide rail, and that the window can be opened horizontally. The opening space range of this window is greater than the tilt window, and therefore, it is widely used in the general houses. However, its sealing and safety characteristics against rain and wind are poor.

Therefore, it is known that tall office buildings sometimes can employ the above described three types collectively. That is, two or three of them are combined in a selective manner.

The present inventor developed an opening/closing device for window by combining the three opening functions of the window, that is, the pivotal opening, the tilt opening and the slide opening. This technique is disclosed in Korean Utility Model Publication No. 89-504 (entitled "Multi-Function Window")

In this multi-function window, two guide grooves are parallelly formed on the upper outer frame, while the lower frame is formed in a stepped shape. A hinge with a guide roller attached thereon is attached on the upper frame of the window, so that the guide roller can move along the guide grooves of the upper outer frame. Further sliding rollers are installed on the both ends of the lower frame of the window, so that the window can be opened through the guide rollers and the sliding rollers when opening the window horizontally. Meanwhile when the window is opened in a pivotal manner, the window is opened by being supported by one end of the upper hinge and the lower roller. Meanwhile, when the window is opened in the tilted manner, the window is opened by being supported by the upper hinge. That is, in this prior art, the three window opening types are selectively used, but its structure is complicated, and the manufacturing cost is too high, as well as being liable to disorders.

The present inventor disclosed another technique in which a single window is installed within an outer frame, so that the window can be opened in a tilted manner and in a pivotal manner. That is, in this window, two opening types are combined, and this technique is proposed in Korean Utility Model Publication No. 91-1118 (entitled "Window opening/closing device").

In this window opening/closing device, the upper frame of a single window which is installed within the outer frame is fixed to the both ends of a link having a certain length. Further, a lock is used to secure or release the link to and from the window frame. There is installed a detachable and couplable hinge on a sealing portion of the window. Thus, when the window is opened in a tilted manner, the link plays the role, while when the window is opened in a pivotal manner, the hinge plays the role. In this window, two composite functions can be selectively used, but the lever mechanism which selectively couples and separates the link and the hinge is complicated, and therefore, the manufacturing cost is high. Further, a large number of components are involved, and therefore, it is liable to disorders.

SUMMARY OF THE INVENTION

The present invention is intended to overcome the above described disadvantages of the conventional techniques.

Therefore it is the object of the present invention to provide a opening/closing device for window, in which two windows installed within an outer frame can be opened and closed by selecting two functions, i.e., a tilt opening manner and slide opening manner.

In achieving the above object, the device of the present invention is constituted as follows.

That is, two guide rails are formed in parallel with each other on the upper segment of the outer frame, and two sliding rails are installed in parallel with each other on the lower segment of the outer frame. The guide rail is provided with a web in which a hole is formed for receiving an auxiliary rail.

Further, two links having guide rollers on other ends are pivotally symmetrically secured to the upper frame of each of the two windows which are installed within the outer frame. The guide rollers are inserted into the guide rail, so that they can move horizontally without detachment.

On the lower frame each of the window, there are installed two sliding rollers together with coil springs by means of shafts in a horizontally slidable manner, so that the windows can horizontally slide along a sliding rail. Thus a roller mechanism is formed, and the sliding rail is formed on the bottom of the outer frame.

On a side of a supporting plate for the sliding roller mechanism, there is installed an auxiliary roller, so that it can slide along the web of the rail. When the window is closed, the auxiliary roller is inserted into a hole of the guide rail, and the sliding roller moves inward owing to the elastic force of the coil spring, with the result that the two windows closely approached together. When the window is opened, the auxiliary roller departs from the hole to move along the web of the guide rail, with the result that the windows maintain a gap from each other, thereby preventing the wear of a sealing packing.

Locks for securing and releasing the links to and from the frame are installed on the both end portions of the upper frame of the window. The locks can be operated by means of a button and a rod, and the button is disposed near a knob of the window.

Therefore, if the button is not pressed, the window can be only slidably opened and closed, while if the button is pressed, the links are released, and the window can be opened and closed in a tilted manner.

The constitution of the present invention is simple compared with the conventional ones, and therefore, the manufacturing cost is lowered. Further, the tilt opening manner and the slide opening manner can be selectively used. Further, the sealing characteristics against rains and winds as well as the safety characteristics are superior. Further, the opening range is large, and therefore, the air ventilation becomes acceptable.

BRIEF DESCRIPTION OF THE DRAWINGS

The above object and other advantages of the present invention will become more apparent by describing in detail the preferred embodiment of the present invention with reference to the attached drawings in which:

FIG. 5 illustrates the operation of the sliding rollers according to the present invention in which:

FIG. 8A and 8B illustrate a plan view of the windows in a closed state; and FIG. 9A and 9B are plan view showing a gap when the window is opened.

DESCRIPTION OF THE PREFERRED EMBODIMENT

Figure 1:
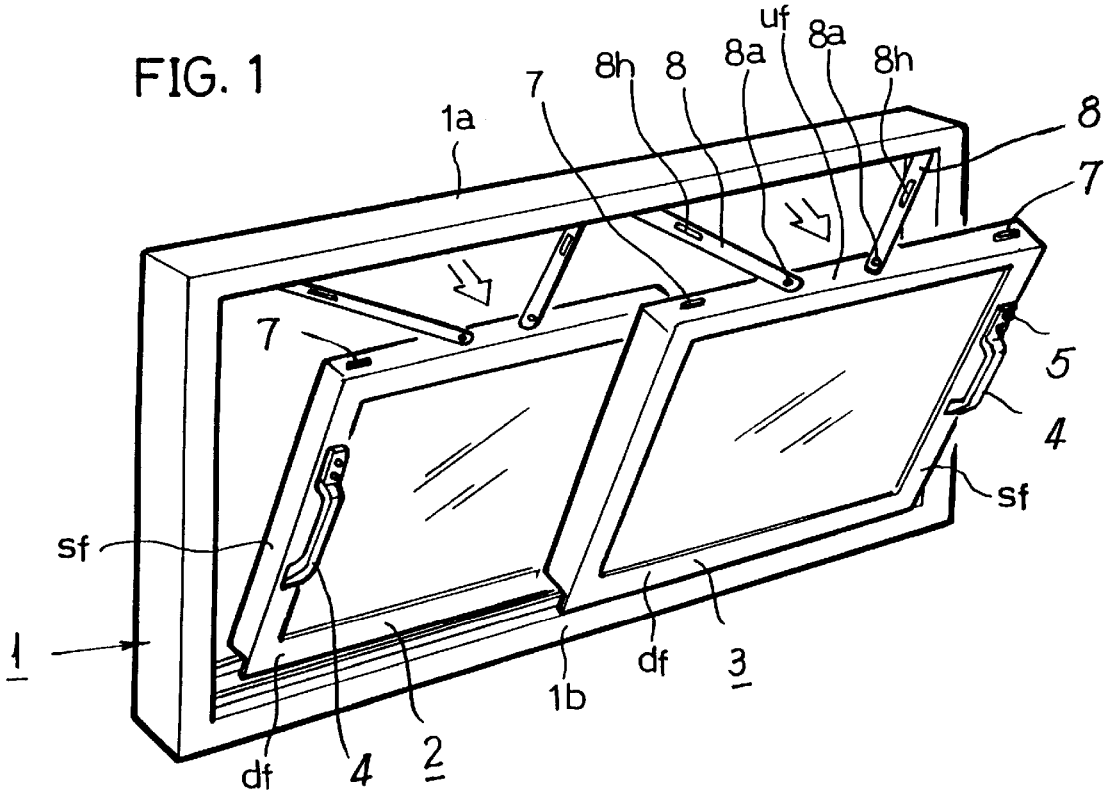
FIG. 1 illustrates the window of the present invention showing the tilt opening of the window.

The window according to the present invention includes two functions, i.e., a tilt opening and a slide opening, and the two functions can be selectively used.

An upper segment 1*a* of an outer frame 1 is provided with two guide rails 11 side by side, and two sliding rails 13 are formed on a lower segment 1*b* of the outer frame 1 side by side. The outer edges of the upper and lower segments 1*a* and 1*b* are respectively provided with flanges 1*c* and 1*c*' to keep off rain drops. The rail 13 is provided with a web 19, and the web 19 is provided with a hole 20 to receive an auxiliary rail.

Figure 3:
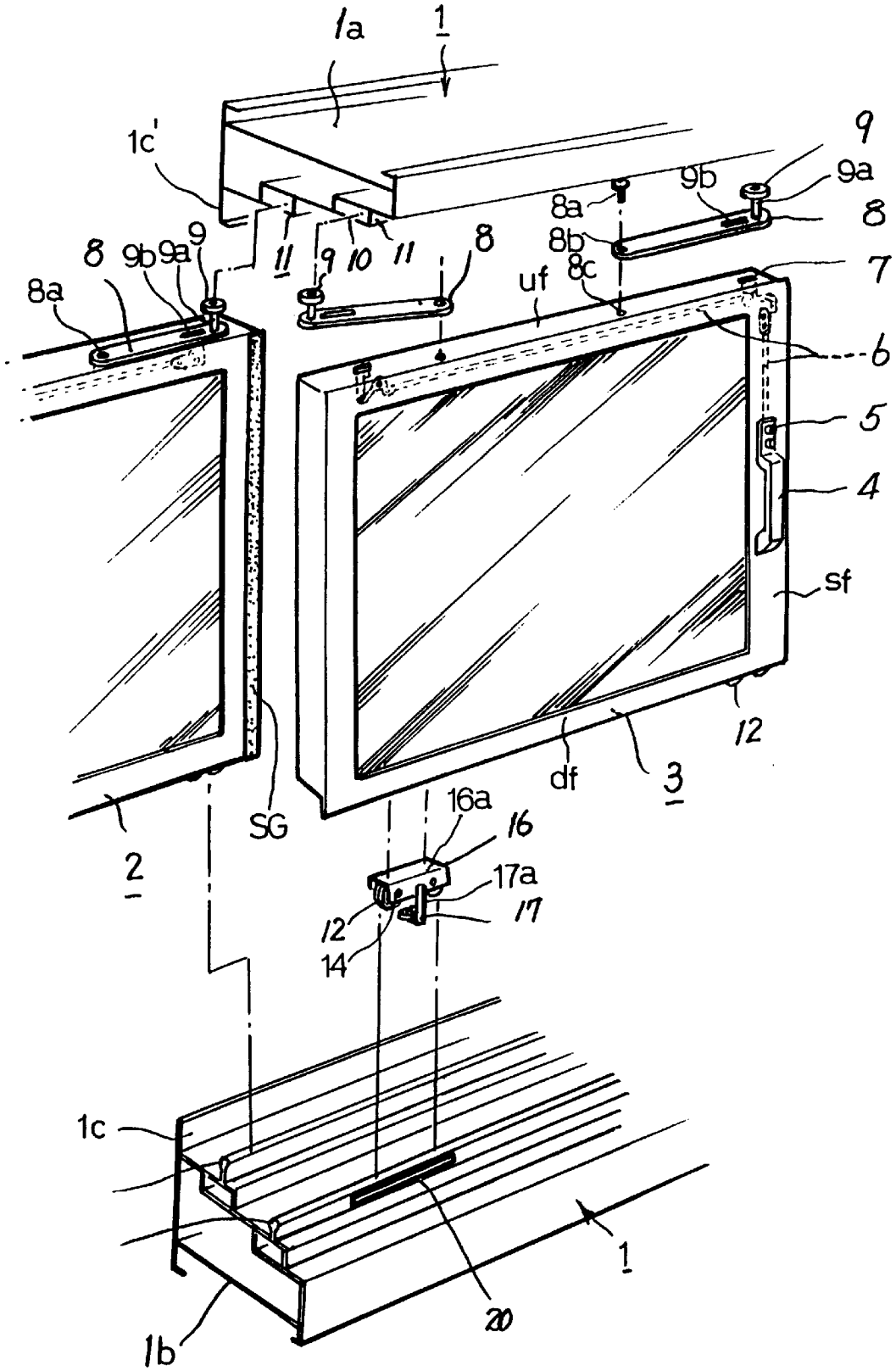
FIG. 3 is an exploded perspective view of the critical portions of the window of the present invention.
Figure 6:
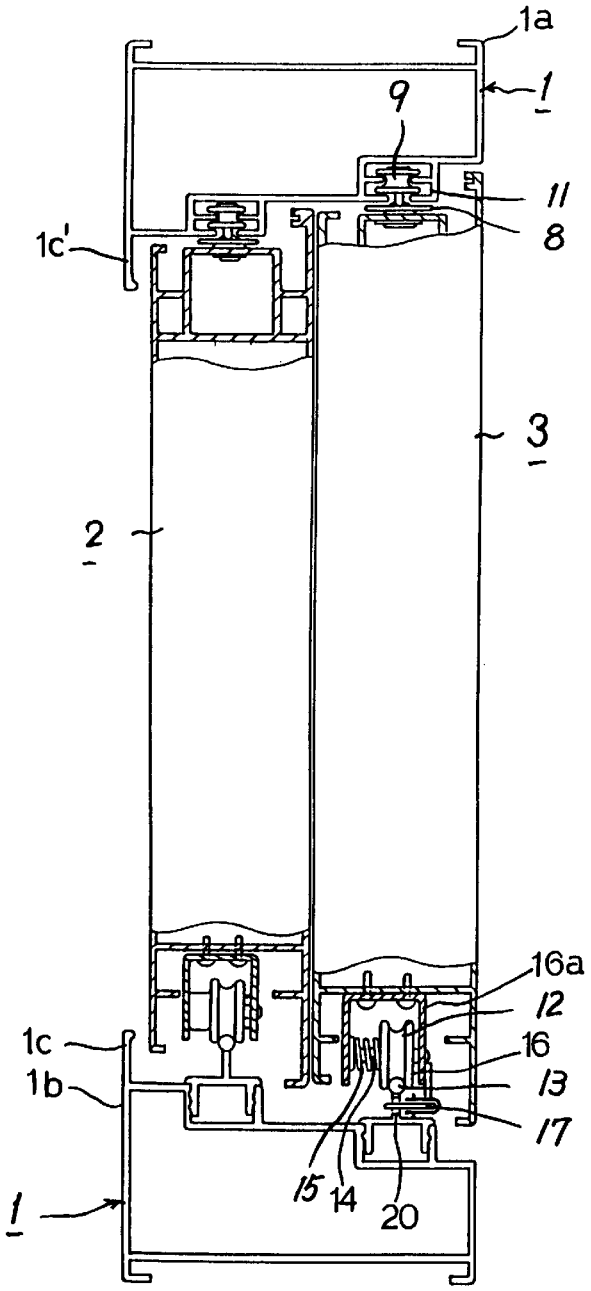
FIG. 6. is a cut-out side view of a part of the window when the window is closed.

As shown in FIG. 3, in the guide rails 11 and the sliding rails 13, there is a height difference of one step between the inner rail and the outer rail, so that windows 2 and 3 can be tilt-opened outwardly. Therefore, as can be seen in FIG. 6, the width of the outer window 3 is greater than that of the inner window 2.

As shown in FIGS. 1 and 3, one ends of a pair of links 8 are connected through a supporting shaft 9*a* to a pair of guide rollers 9 respectively, while the other ends of the links 8 are pivotally connected through supporting pins 8*a* to holes 8*b* and 8*c* and to the upper frame uf respectively in a symmetric relation. The guide rollers 9 which are connected to the links 8 are installed into the guide rails 11 which are formed on the upper segment 1*a* of the outer frame 1.

Figure 4:
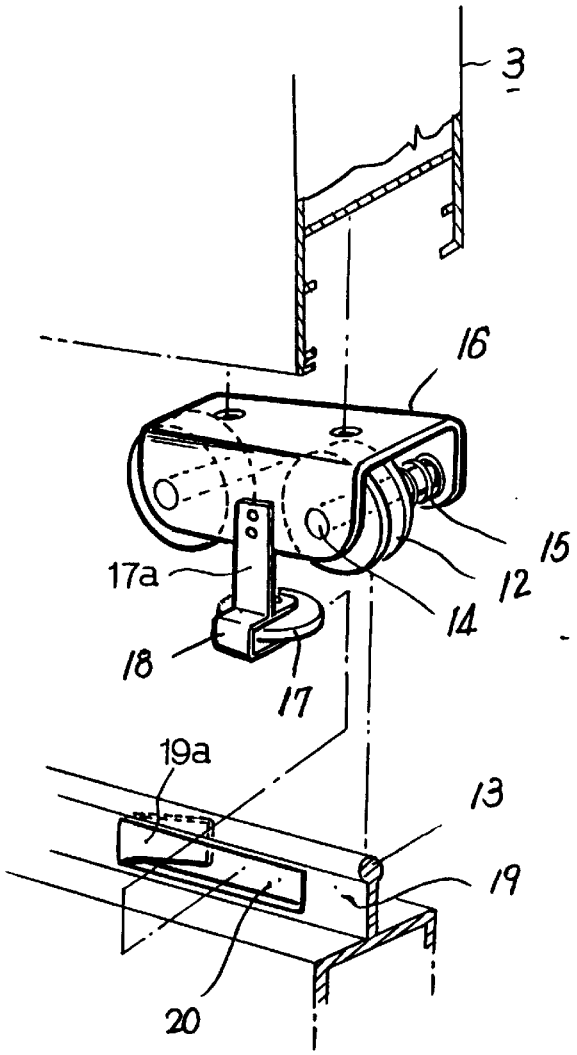
FIG. 4 is an exploded perspective view of the sliding roller mechanism according to the present invention.

As shown in FIGS. 4 and 5, on the bottoms of lower frame df of the windows 2 and 3, there are installed a pair of sliding roller mechanisms 16, in such a manner that the windows can be maintained horizontally. A sliding roller 12 of the roller mechanism 16 is laid upon the sliding rail 13 which is installed on the lower segment 1*b* of the outer frame 1.

The sliding roller mechanism 16 is installed in the following manner. That is, the sliding roller 12 is secured through a supporting shaft 14 to a supporting plate 16*a*, and the sliding roller 12 can horizontally moved together with a coil spring 15. On a side of the supporting plate 16*a*, there is installed a supporting plate 17*a* of an auxiliary roller 17. As shown in FIG. 5B, this auxiliary roller 17 moves along the web 19 of the sliding rail 13, and at the same time, maintains a gap c between the two windows 2 and 3, so that a seal packing sg of the windows is prevented from being worn off.

Figure 5A:
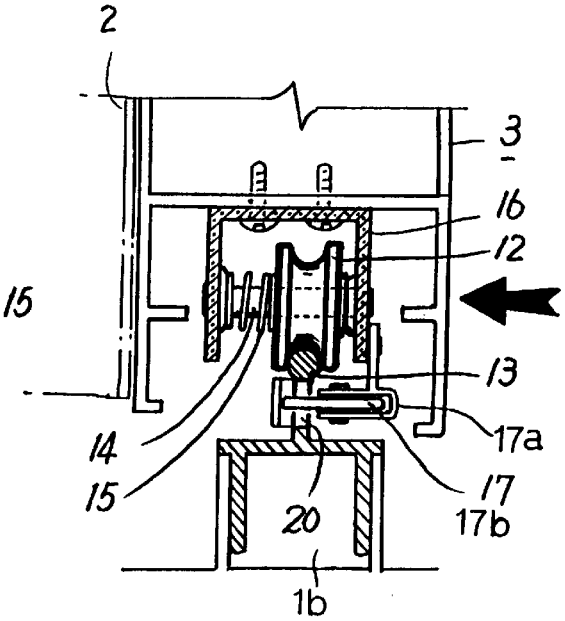
FIG. 5A illustrates a rightward biasing of the sliding roller when the window is closed.
Figure 5B:
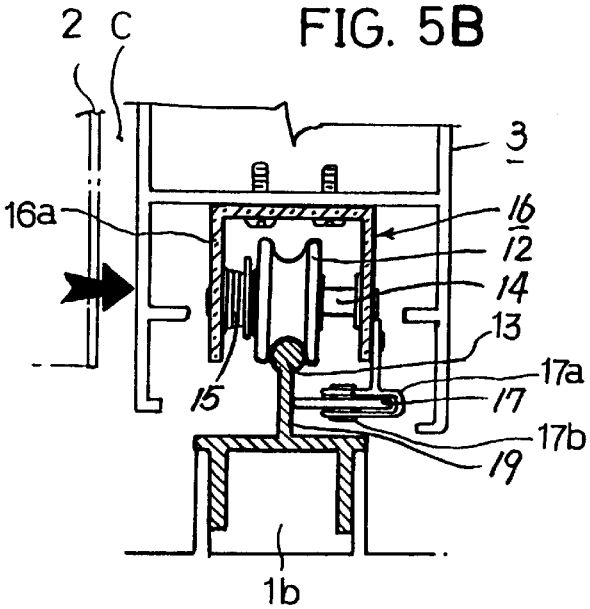
FIG. 5B illustrates a leftward biasing of the sliding roller when the window is opened.

When the windows are closed, as shown in FIG. 5A, the auxiliary roller 17 enters into the hole 20 of the web 19 of the sliding rail 13. Consequently, owing to the elastic force of the coil spring 15, the sliding roller 12 is biased inward, with the result that the windows 2 and 3 are closely approached together, thereby preventing the intrusion of rains and winds.

As shown in FIG. 3, on the both end portions of the upper frames uf of the windows 2 and 3, there are installed locks 7 for locking or releasing the links 8 to and from the upper frame uf. The lock 7 is operated by means of a button 5 which is installed adjacently to a window knob 4. The button 5 is operable through a rod 6 which extends through the interiors of the frames df and uf. In accordance with the manipulation of the button 5, the lock 7 protrudes and withdraws to and from the outside of the frame uf, and is inserted into a locking hole 8*h* of the link 8, so as to be locked or released to and from the frame uf.

The opening/closing device for windows of the present invention constituted as above will now be described as to its actuation.

As can be seen in FIG. 6, when the two windows 2 and 3 installed within the outer frame 1 are closed, the two windows 2 and 3 approach to each other, and therefore, the sealing characteristics of the window become good owing to the close contact of the sealing packings sg. That is, the sealing packings sg are closely contacted to the flanges 1*c* and 1*c*' of the outer frame 1, and therefore, the intrusion of rains and winds through the windows can be effectively prevented.

Figure 7:
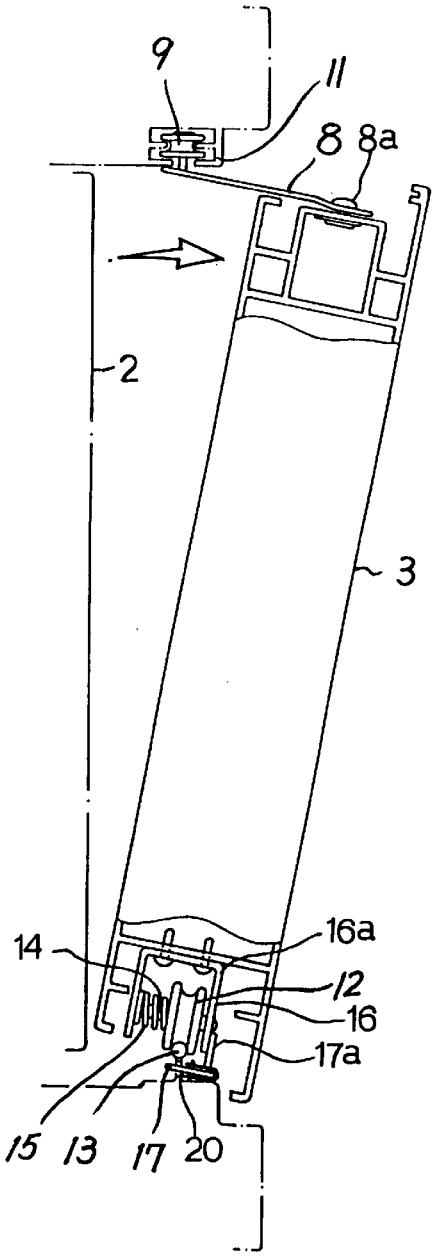
FIG. 7 illustrates a cut-out side view of the window in a state with the window opened in a tilted manner.

FIGS. 1 and 7 illustrate an opening state of the windows in a tilt manner, by being opened from a state with the windows sealingly closed. First, the button 5 which is installed adjacently to the window knob 4 of the window is pressed. Then owing to the function of the button, the rod 6 performs an interlocking movement so as to release the lock 7 from the locking hole 8*h* of the link 8 and to be inserted into the upper frame uf of the window, thereby releasing the link 8 from a locked state to a released state.

Under this condition, as shown in FIG. 1, the upper portions of the windows 2 and 3 are pushed outward so as for them to be opened. Under this condition, the links 8 of the windows 2 and 3 are protruded from the outer frame 1 owing to the functions of the rollers 9 and the supporting shaft 8*a*, thereby inclinedly opening the windows outward. Meanwhile, the sliding rollers 12 which are installed on the bottoms of the windows support the inclining of the windows by being supported by the sliding rails 13. Thus the windows 2 and 3 are inclinedly opened, so that the air ventilation may be sufficiently carried out.

In another embodiment, if the links 8 of the windows 2 and 3 are installed on the bottom frames df of the windows, then the lower portions of the windows are opened with an opposite inclination angle.

As shown in FIG. 5, in an initial state when the windows are initially closed, the auxiliary roller 17 of the lower portion of the window is inserted into the hole 20 of the web 19 of the sliding rail 13. Therefore, when the windows 2 and 3 are being outwardly opened, the auxiliary roller 17 freely moves within the hole 20 as shown in FIG. 7, and therefore, the auxillary roller 17 does not act as an impediment during the inclined opening of the windows. Further, the contact point between the sliding roller 12 and the sliding rail 13 corresponds to the supporting point for maintaining the opening angle, and therefore, the tilt opening of the window can be realized in a smooth manner.

Figure 2:
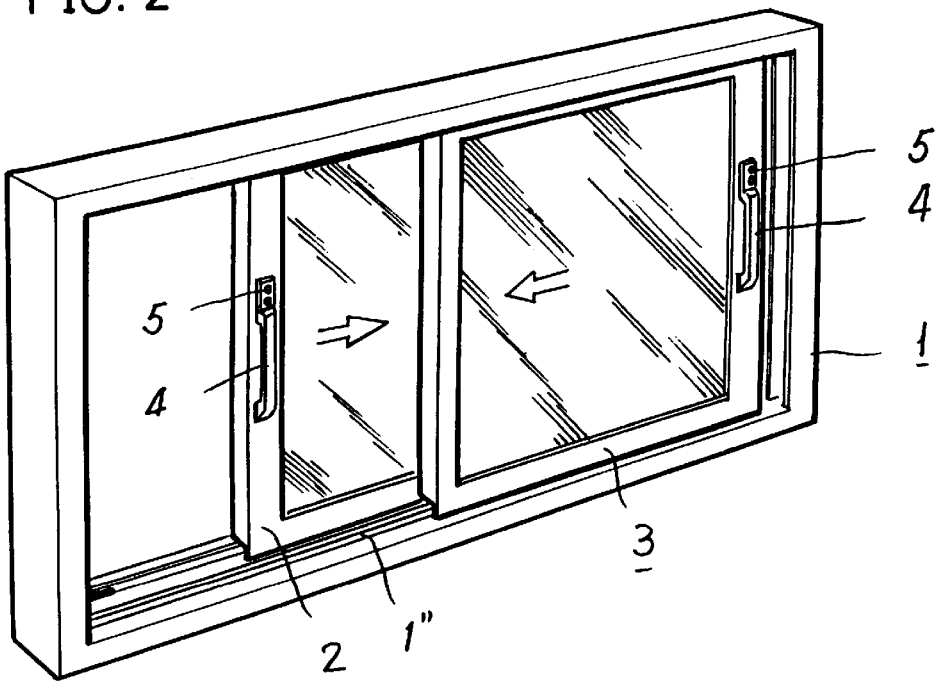
FIG. 2 illustrates the window of the present invention showing the slide opening of the window.

FIG. 2 illustrates the window of the present invention showing the slide opening of the windows 2 and 3.

In this case, the windows 2 and 3 are opened in a horizontally sliding manner in any direction as in the case of the ordinary windows. Under this condition, the guide rollers 9 slide horizontally together with the windows 2 and 3 along the guide rails 11 which are formed on the upper segment 1*a* of the outer frame 1. Meanwhile, the sliding rollers 12 roll along the sliding rails 13 which are installed on the lower segment 1*b* of the outer frame 1, with the result that the windows are opened in the desired direction.

The auxiliary roller 17 which has been inserted into the hole 20 of the web 19 of the sliding rail 13 as shown in FIG. 8 in a closed state departs from the hole 20 along the guide plate 19*a* in the initial opening stage as shown in FIG. 9, and moves along the web 19 of the sliding rail 13.

Therefore, as shown in FIG. 5B, the sliding rollers 12 compress the coil springs 15 to be biased leftward along the supporting shafts 14. Consequently, the two windows 2 and 3 form a gap between each other so as to slide smoothly as shown in FIG. 9.

Thus, during the moving of the windows, there is formed a gap between the windows owing to the auxiliary roller 17, and therefore, the sealing packings which are attached on the edges of the windows are prevented from being put to frictions, and from being worn. Therefore, the sealing of the windows can be maintained for a long time.

Further, the device of the present invention can be installed on the two windows, and the structure is simple. Further, the windows are provided two functions, i.e., the tilt opening and the slide opening, and therefore, the windows can be selectively opened by employing any one of the two functions.

Further, the safety characteristics and the rain and wind sealing characteristics of the windows are very high, and therefore, the device of the present invention can be installed on tall office buildings and apartment buildings.

What is claimed is:

1. Windows having an opening and closing device comprising:

guide rails formed on a top segment of an outer frame;

a pair of links for connecting an upper frame of each of said windows to each of said guide rails, said links being slidable along said guide rails;

a pair of sliding rails formed on a bottom segment of said outer frame; and a sliding roller mechanism installed between each of said sliding rails and a lower frame of each of said windows, whereby said windows are provided with two functions, a tilt opening function and a slide opening function, said two functions being selectively used, wherein said links are respectively provided with a locking hole.

2. The opening and closing device for windows as claimed in claim 1, wherein there is respectively a stepped height difference between an outer rail and an inner rail of said guide rails and said sliding rails.

3. The an opening and closing device for windows as claimed in claim 1, wherein said links are pivotally secured to the upper frame of each of said windows, said links are respectively provided with guide rollers on outer tips thereof, and said guide rollers are horizontally connected to each of said guide rails.

4. The opening/closing device for windows as claimed in claim 1, wherein said sliding roller mechanisms installed on the lower frame of each of said windows are movable along said sliding rail of the bottom segment of said outer frame.

5. Windows having opening/closing device comprising:

guide rails formed on a top segment of an outer frame;

a pair of links for connecting an upper frame of each of said windows to each of said guide rails, said links being slidable alone said guide rails;

a pair of sliding rails formed on a bottom segment of said outer frame; and a sliding roller mechanism installed between each of said sliding rails and a lower frame of each of said windows, whereby said windows are provided with two functions, a tilt opening function and a slide opening function, said two functions being selectively used, and wherein a web of said sliding rail is provided with a guide plate and a hole for receiving an auxiliary roller.

6. The opening and closing device for windows as claimed in claim 5, wherein said auxiliary roller is attached on a side of a supporting plate of said sliding roller and is movable along said web of said sliding rail.

7. The opening and closing device for windows as claimed in claim 5, wherein if said auxiliary roller is inserted into said hole of said web of said sliding rail, said windows closely approach to each other, and if said auxiliary roller departs from said hole to contact with said web, there is formed a gap between said two windows.

8. Windows having opening/closing device comprising:

guide rails formed on a top segment of an outer frame;

a pair of links for connecting an upper frame of each of said windows to each of said guide rails, said links being slidable along said guide rails;

a pair of sliding rails formed on a bottom segment of said outer frame; and a sliding roller mechanism installed between each of said sliding rails and a lower frame of each of said windows, whereby said windows are provided with two functions, a tilt opening function and a slide opening function, said two functions being selectively used, and a button adjacently to a knob of each of said windows so as to be connected to a rod, said rod extending through an interior of said frame; and locks installed in both end portions of each of said windows so as to be connected to said rod, whereby manipulations of said button cause said locks to be coupled or detached to and from said locking hole so as to make said links locked or released to and from said frame.

9. The opening and closing device for windows as claimed in claim 8, wherein if said button is not touched, said links are fixed on the upper frame of each of said windows so as to make it possible to open/close said windows in a sliding manner.

10. The opening and closing device for windows as claimed in claim 8, wherein if said button is pushed, said links are released so as to make it possible to open/close said windows in a tilt manner.

11. Windows having an opening and closing device comprising:

guide rails formed on a top segment of an outer frame;

a pair of links for connecting an upper frame of each of said windows to each of said guide rails, said links being slidable along said guide rails;

a pair of sliding rails formed on a bottom segment of said outer frame; and a sliding roller mechanism installed between each of said sliding rails and a lower frame of each of said windows, wherein said sliding roller mechanism comprises a supporting plate, a supporting shaft, a sliding roller, and a coil spring, whereby said sliding roller is biased to left or right, and whereby said windows are provided with two functions, a tilt opening function and a slide opening function, said two functions being selectively used.

12. Windows having an opening and closing device comprising:

guide rails formed on a top segment of an outer frame;

a pair of links for connecting an upper frame of each of said windows to each of said guide rails;

locking members for attaching said links on the upper frame;

a sliding roller and an auxiliary roller; and a web of sliding rails provided with a guide plate and a hole for receiving said auxiliary roller;

whereby said windows are provided with two functions, a tilt opening function and a slide opening function, said two functions being selectively used.

* * * * *